US008854174B2

(12) United States Patent
Su et al.

(10) Patent No.: US 8,854,174 B2
(45) Date of Patent: Oct. 7, 2014

(54) FUSED DISCONNECT SWITCH WITH TERMINAL OPENING COVER

(75) Inventors: Jiehua Su, Shanghai (CN); Matthew Rain Darr, Edwardsville, IL (US)

(73) Assignee: Cooper Technologies Company, Houston, TX (US)

( * ) Notice: Subject to any disclaimer, the term of this patent is extended or adjusted under 35 U.S.C. 154(b) by 307 days.

(21) Appl. No.: 13/040,804

(22) Filed: Mar. 4, 2011

(65) Prior Publication Data

US 2011/0221563 A1 Sep. 15, 2011

(30) Foreign Application Priority Data

Mar. 12, 2010 (CN) ..... 2010 1 0144175

(51) Int. Cl.

| | |
|---|---|
| ***H01H 71/54*** | (2006.01) |
| ***H01H 71/20*** | (2006.01) |
| ***H01H 9/10*** | (2006.01) |
| ***H01H 21/16*** | (2006.01) |
| *H01H 1/20* | (2006.01) |
| *H01H 71/12* | (2006.01) |

(52) U.S. Cl.

CPC ..... *H01H 9/104* (2013.01); *H01H 71/54* (2013.01); *H01H 1/20* (2013.01); *H01H 21/16* (2013.01); *H01H 71/122* (2013.01)

USPC ..... 337/149; 337/4; 337/143; 337/194; 337/187; 337/242; 361/104; 361/626

(58) Field of Classification Search

CPC ..... H01H 21/16; H01H 9/104; H01H 1/20; H01H 71/122; H01H 71/54

USPC ..... 337/4, 143, 149, 194, 187, 242; 361/104, 626; D13/160, 178

See application file for complete search history.

(56) References Cited

U.S. PATENT DOCUMENTS

| | | | | |
|---|---|---|---|---|
| 3,614,697 | A * | 10/1971 | Dunham et al. | 337/6 |
| 3,958,197 | A * | 5/1976 | Gryctko | 335/18 |
| 3,958,204 | A * | 5/1976 | Gryctko | 337/6 |
| 4,168,104 | A * | 9/1979 | Buschow | 439/137 |
| 4,868,535 | A * | 9/1989 | Janniere et al. | 337/68 |
| 5,355,274 | A * | 10/1994 | Marach et al. | 361/104 |
| 5,559,662 | A * | 9/1996 | Happ et al. | 361/104 |
| 5,841,337 | A | 11/1998 | Douglass | |
| 5,915,981 | A * | 6/1999 | Mehta | 439/137 |
| 6,157,287 | A | 12/2000 | Douglass et al. | |
| 6,587,028 | B2 * | 7/2003 | Mollet et al. | 337/194 |
| 6,696,969 | B2 | 2/2004 | Torrez et al. | |
| 6,717,505 | B1 * | 4/2004 | Bruchmann | 337/194 |

(Continued)

FOREIGN PATENT DOCUMENTS

| | | |
|---|---|---|
| DE | 29714131 U1 | 11/1997 |
| EP | 0184652 A2 | 6/1986 |

OTHER PUBLICATIONS

International Search Report and Written Opinion of PCT/US2011/023123; Apr. 28, 2011; 13 pages.

*Primary Examiner* — Anatoly Vortman

(74) *Attorney, Agent, or Firm* — Armstrong Teasdale LLP

(57) ABSTRACT

A fusible switching disconnect device includes a switch housing and terminal cover therefore that blocks access to a line side fuse clip and prevents insertion of a rectangular fuse module when switch contacts in the device are closed. An interlock element further presents the fuse from being retracted when the switch contacts are closed.

51 Claims, 5 Drawing Sheets

(56) References Cited

U.S. PATENT DOCUMENTS

| | | | | |
|---|---|---|---|---|
| 6,727,797 | B1 * | 4/2004 | Bruchmann | 337/210 |
| 6,784,783 | B2 * | 8/2004 | Scoggin et al. | 337/194 |
| 6,998,954 | B2 * | 2/2006 | Milanczak | 337/194 |
| 7,355,503 | B2 * | 4/2008 | Buettner | 337/211 |
| 7,474,194 | B2 * | 1/2009 | Darr et al. | 337/72 |
| 2005/0285710 | A1 * | 12/2005 | Buettner | 337/231 |
| 2007/0063808 | A1 | 3/2007 | Darr et al. | |
| 2007/0252670 | A1 | 11/2007 | Darr | |
| 2008/0042794 | A1 | 2/2008 | Darr | |

* cited by examiner

FUSED DISCONNECT SWITCH WITH TERMINAL OPENING COVER

CROSS REFERENCE TO RELATED APPLICATIONS

This application is based on and claims the benefit of priority from Chinese Patent Application No. 20101044175.1 filed 12 Mar. 2010, the disclosure of which is hereby incorporated by reference in its entirety.

BACKGROUND OF THE INVENTION

The field of the invention relates generally to fused disconnect switches, and more specifically to fused disconnect switches including fuse receptacles with pass through openings for blade terminals of a fuse.

Fuses are widely used as overcurrent protection devices to prevent costly damage to electrical circuits. Fuse terminals typically form an electrical connection between an electrical power source and an electrical component or a combination of components arranged in an electrical circuit. One or more fusible links or elements, or a fuse element assembly, is connected between the fuse terminals, so that when electrical current through the fuse exceeds a predetermined limit, the fusible elements melt and open one or more circuits through the fuse to prevent electrical component damage.

A variety of fusible disconnect switches are known in the art wherein fused output power may be selectively switched from a power supply. Existing fusible disconnect switch devices, however, have not completely met the needs of those in the art.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION OF THE INVENTION

Compact fusible switching disconnect devices have been recently developed that emulate the switching capability of circuit breakers commonly used in combination with fuses in certain applications, but do not involve circuit breakers. Thus, when such compact fusible switching disconnect devices are utilized in panelboards, the circuit breakers may be eliminated and current interruption ratings of the board may be increased, as well as reducing the size of the panelboard. The disconnect devices also accommodate the fuses without involving a separately provided fuse holder, and also establish electrical connection without fastening of the fuse to the line and load side terminals. While such fusible disconnects are superior in many ways to known fusible disconnect assemblies, improvements are desired.

Figure 1:
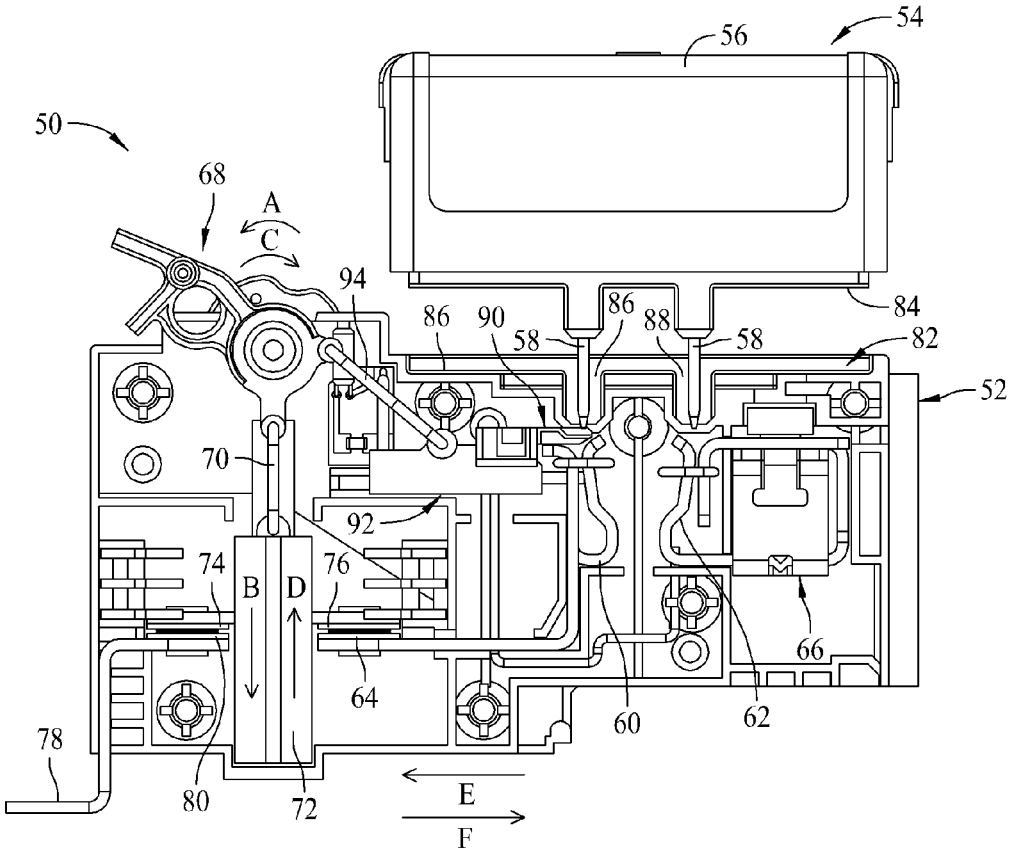
FIG. 1 is a side elevational view of an exemplary fused disconnect switch assembly including a fuse module and a switch housing module.

Referring now to the drawings, FIG. 1 is a side elevational view of an exemplary fused disconnect switch assembly 50 including a non-conductive switch housing 52 configured or adapted to receive a retractable rectangular fuse module 54. The fuse module 54 is a known assembly including a rectangular housing 56, and terminal blades 58 extending from the housing 56. A primary fuse element or fuse assembly is located within the housing 56 and is electrically connected between the terminal blades 58. Such fuse modules 54 are known and in one embodiment the rectangular fuse module is a CUBEFuse™ power fuse module commercially available from Cooper/Bussmann of St. Louis, Mo.

A line side fuse clip 60 may be situated within the switch housing 52 and may receive one of the terminal blades 58 of the fuse module 54. A load side fuse clip 62 may also be situated within the switch housing 52 and may receive the other of the fuse terminal blades 58. The line side fuse clip 60 may be electrically connected to a line side terminal including a stationary switch contact 64. The load side fuse clip 62 may be electrically connected to a load side terminal 66.

A rotary switch actuator 68 is further provided on the switch housing 52, and is mechanically coupled to an actuator link 70 that, in turn is coupled to a sliding actuator bar 72. The actuator bar 72 carries a pair of switch contacts 74 and 76. A load side terminal 78 including a stationary contact 80 is also provided. Electrical connection to power supply circuitry may be accomplished in a known manner using the line side terminal 78, and electrical connection to load side circuitry may be accomplished in a known manner using the load side terminal 66. A variety of connecting techniques are known (e.g., screw clamp terminals and the like) and may be utilized. The configuration of the terminals 78 and 66 shown are exemplary only.

Disconnect switching may be accomplished by rotating the switch actuator 68 in the direction of arrow A, causing the actuator link 70 to move the sliding bar 72 linearly in the direction of arrow B and moving the switch contacts 74 and 76 toward the stationary contacts 64 and 80. Eventually, the switch contacts 74 and 76 become mechanically and electrically engaged to the stationary contacts 64 and 80 and a circuit path may be closed through the fuse 54 between the line and load terminals 78 and 66 as shown in FIG. 1 when the fuse terminal blades 58 are received in the line and load side fuse clips 60 and 62.

Figure 8:
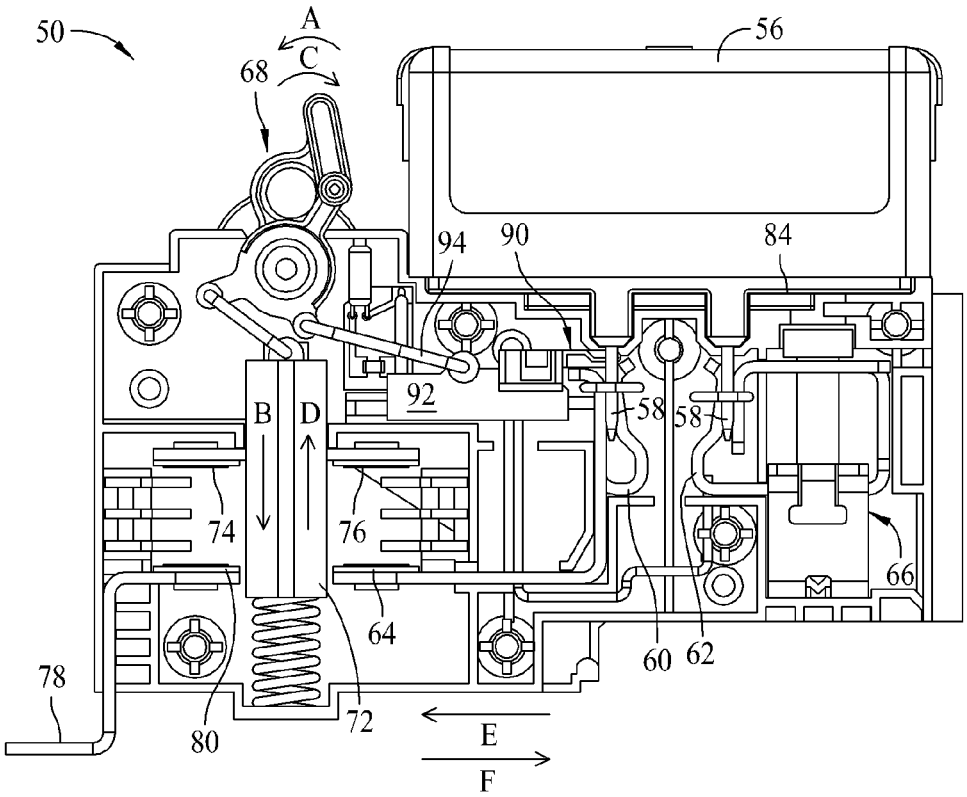
FIG. 8 illustrates the fuse module fully engaged to the switch housing module.

When the actuator 68 is moved in the opposite direction indicated by arrow C in FIG. 1, the actuator link 70 causes the sliding bar 72 to move linearly in the direction of arrow D and pull the switch contacts 74 and 76 away from the stationary contacts 64 and 80 to open the circuit path through the fuse 54 as shown in FIG. 8. As such, by moving the actuator 68 to a desired position, the fuse 54 and associated load side circuitry may be connected and disconnected from the line side circuitry while the line side circuitry remains "live" in full power operation.

Additionally, the fuse module 54 may be simply plugged into the fuse clips 60, 62 or extracted therefrom to install or remove the fuse module 54 from the switch housing 52. The fuse housing 56 projects from the switch housing 52 and is open and accessible so that a person can grasp the fuse housing 56 by hand and pull it in the direction of arrow B to disengage the fuse terminal blades 58 from the line and load side fuse clips 60 and 62 such that the fuse module 54 is completely released from the switch housing 52. Likewise, a replacement fuse module 54 can be grasped by hand and moved toward the switch housing 52 to engage the fuse terminal blades 58 to the line and load side fuse clips 60 and 62.

Such plug-in connection and removal of the fuse module 54 advantageously facilitates quick and convenient installation and removal of the fuse 54 without requiring separately supplied fuse carrier elements and without requiring tools or fasteners common to other known disconnect devices. Also, the fuse terminal blades 58 project from a lower side of the fuse housing 56 that faces the switch housing 52. Moreover, the fuse terminal blades 58 extend in a generally parallel manner projecting away from the lower side of the fuse module 54 such that the fuse housing 56 (as well as a person's hand when handling it) is physically isolated from the conductive fuse terminals 58 and the conductive line and load side fuse clips 60 and 62. The fuse module 54 is therefore touch safe (i.e., may be safely handled by hand without risk of electrical shock) when installing and removing the fuse 54.

Additionally, the disconnect device 50 is rather compact and can easily occupy less space in a fusible panelboard assembly, for example, than conventional in-line fuse and circuit breaker combinations. In particular, CUBEFuse™ power fuse modules occupy a smaller area, sometimes referred to as a footprint, in the panel assembly than non-rectangular fuses having comparable ratings and interruption capabilities. Reductions in the size of panelboards are therefore possible, with increased interruption capabilities.

In ordinary use, the circuit is preferably connected and disconnected at the switch contacts 64, 74, 76 and 80 rather than at the fuse clips 60 and 62. Electrical arcing that may occur when connecting/disconnecting the circuit may be contained at a location away from the fuse clips 60 and 62 to provide additional safety for persons installing, removing, or replacing fuses. By opening the disconnect module 50 with the switch actuator 68 before installing or removing the fuse module 54, any risk posed by electrical arcing or energized metal at the fuse and housing interface is eliminated. The disconnect module 50 is accordingly believed to be safer to use than many known fused disconnect switches.

The disconnect switching device 50 includes still further features, however, that improve the safety of the device 50 in the event that a person removes the fuse module 54 without operating the actuator 68 to disconnect the circuit through the fuse module 54.

As shown in FIG. 1, the switch housing 52 in one example includes an open ended receptacle or cavity 82 on an upper edge thereof that accepts a portion of the fuse housing 56 when the fuse module 54 is installed with the fuse terminal blades 58 engaged to the fuse clips 60, 62. The receptacle 82 is shallow in the embodiment depicted, such that the only a small portion of the fuse housing 56 is received therein, which facilitates the finger safe handling of the fuse module 54 for installation and removal without requiring tools. It is understood, however, that in other embodiments the fuse housing 56 need not project as greatly from the switch housing receptacle when installed, and indeed could even be substantially entirely contained with the switch housing 52 if desired.

In the exemplary embodiment shown, the fuse housing 56 includes a recessed guide rim 84 having a slightly smaller outer perimeter than a remainder of the fuse housing 56, and the guide rim 84 is seated in the switch housing receptacle 82 when the fuse module 54 is installed. It is understood, however, that the guide rim 84 may be considered entirely optional in another embodiment and need not be provided.

The switch housing receptacle 82 further includes a bottom surface 86, sometimes referred to as a floor, that includes first and second openings 86 and 88 formed therein and through which the fuse terminal blades 58 may be extended to engage them with the line and load side fuse clips 60 and 62. As shown in FIG. 1 and in the magnified view in FIG. 2, however, a slidable nonconductive terminal cover 90 is provided that closes the line side opening 86 in the switch housing fuse receptacle 82 and prevents the line side terminal blade 58 from coming into contact with the line side fuse clip 60 when the switch actuator 68 is moved to an "on" position. As such, the terminal cover 90 prevents a fuse module 54 from being installed when the switch actuator is the "on" position closing the switch contacts 74 and 76 and hence electrically connecting the line side fuse clip 60 to power supply circuitry. In such a condition the line side fuse clip 60 is "live" or energized at normal operating power, and by preventing the line side fuse terminal 58 from coming into contact with it via the terminal cover 90, electrical arcing conditions that otherwise may occur are avoided entirely.

Figure 4:
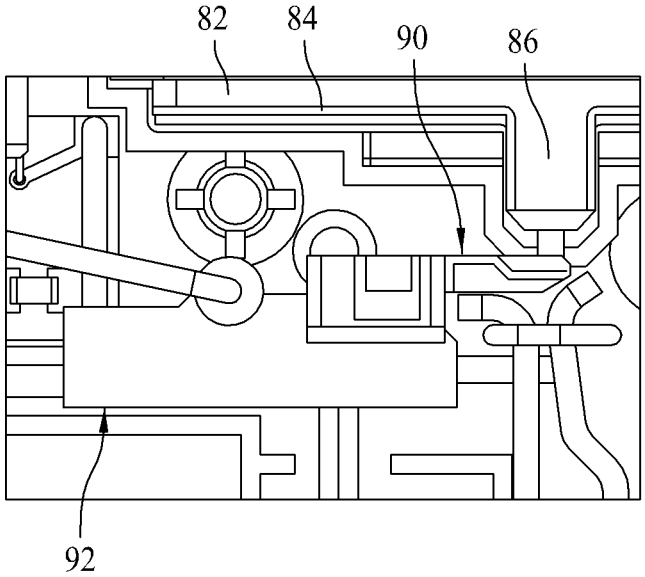
FIG. 4 is a view similar to FIG. 3 but illustrating the terminal cover in an open position when the switch contacts in the switch housing module are opened.
Figure 5:
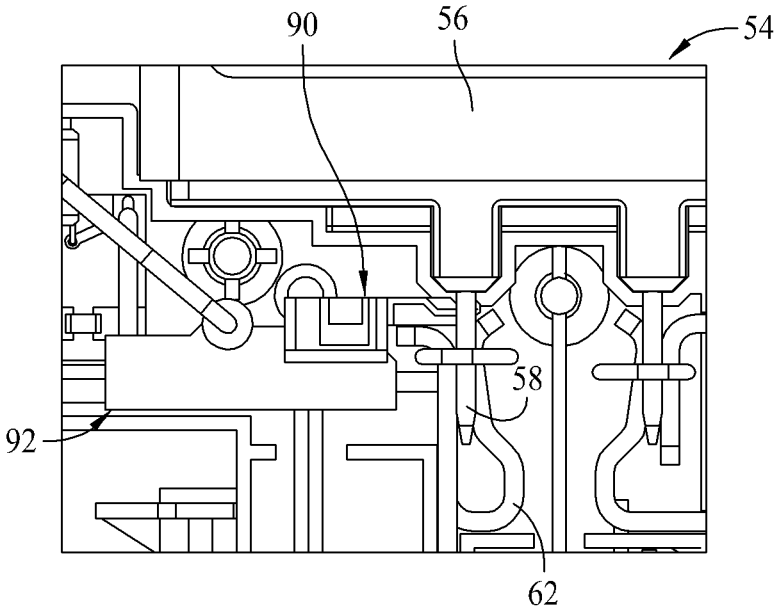
FIG. 5 is a view similar to FIG. 2 with the fuse module engaged to the switch module and the switch contacts closed.

In the example shown, the terminal cover 90 is coupled to an interlock element 92, that is turn coupled to the switch actuator 68 via a positioning arm or link 94. As the switch actuator 68 is rotated in the direction of arrow C to open the switch contacts 64 and 80 or open or turn the device "off" as shown in FIG. 8, the link 94 pulls the interlock element 92 and also the terminal cover 90 along a linear axis in the direction of arrow E away from the line side fuse clip 60, and hence permitting access for the line side terminal blade 58 of the fuse extend through the line side opening 86 in the switch housing fuse receptacle 82 and into the line side fuse clip 60 as best seen in the magnified view of FIG. 4. In this state, the slidable terminal cover 90 clears the line side opening 86 and permits plug-in connection of the line side terminal blade 58 to the line side fuse clip 60 as shown in FIGS. 5 and 8.

When the switch actuator 68 is rotated in the direction of arrow A, however, to the closed or "on" position (FIG. 1) wherein the switch contacts 74 and 76 are engaged with the stationary contacts 64 and 80, the interlock element 92 and the terminal cover 90 are slidably moved toward the line side fuse clip 60 along the liner axis in the direction of arrow F. The terminal cover 90 is accordingly moved toward the line side fuse clip 60 and blocks the line side opening 86 in the switch housing fuse receptacle 86. As such, the terminal cover 90 effectively blocks access to the line side fuse clip 60 and would frustrate any effort to install the fuse module 54. The line side terminal blade 58 of the fuse module 54 would hit the terminal cover 90 during any attempt to plug the fuse module 54 into the switch housing receptacle 82 in this condition. This is perhaps particularly evident in the perspective, magnified view shown in FIG. 3 wherein a leading end of the terminal cover 90 is positioned between a distal end of the line side fuse terminal 60 and the line side opening 86 in the fuse receptacle 82.

It should now be evident that the switch actuator 68 simultaneously drives the sliding bar 72 along a first linear axis (i.e., a vertical axis per FIGS. 1 and 8 as drawn) in the direction of arrow B or D and the slidable interlock element 92 and terminal cover 90 along a second linear axis (i.e., a horizontal axis per FIGS. 1 and 8 as drawn) in the direction of arrows E or F. Specifically, as the sliding bar 72 is moved in the direction of arrow B, the interlock element 92 and the terminal cover 90 are driven in the direction of arrow F toward the line side fuse clip 60. Likewise, when the sliding bar 72 is moved in the direction of arrow D, the interlock element 92 and the terminal cover 90 are driven in the direction of arrow E away from the line side fuse clip 60. The mutually perpendicular axes for the sliding bar 72 and the interlock element 92 and terminal cover 90 are beneficial in that that the actuator 68 is stable in either the opened "off" position (FIG. 8) or the closed "on" position (FIG. 1) and a compact size of the disconnect device 50 is maintained. It is understood, however, that such mutually perpendicular axes of motion are not necessarily required for the sliding bar 72 and the interlock element 92 and terminal cover 90. Other axes of movement are possible and may be adopted in alternative embodiments. On this note too, linear sliding movement is not necessarily required for these elements to function, and other types of movement (e.g., rotary or pivoting movement) may be utilized for these elements if desired.

Figure 6:
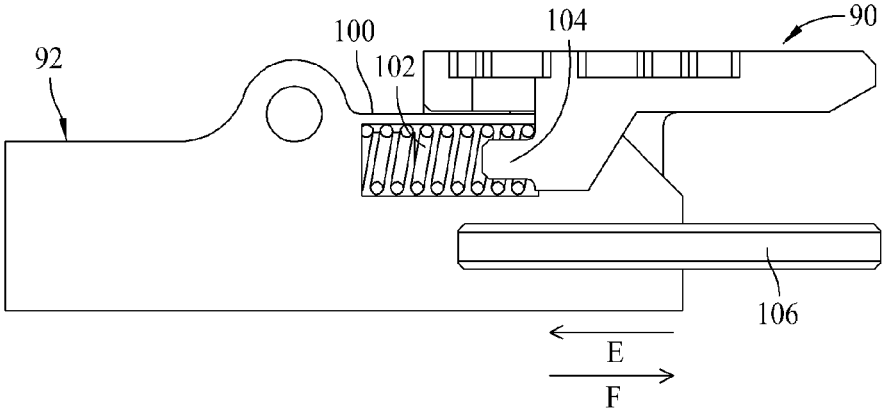
FIG. 6 illustrates an exemplary switch interlock including a terminal cover in a first position.
Figure 7:
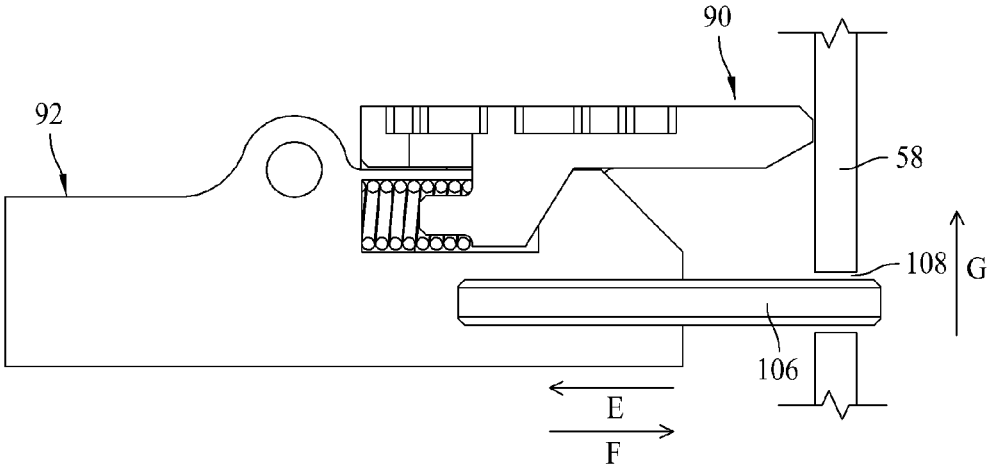
FIG. 7 illustrates the exemplary switch interlock shown in FIG. 6 with the terminal cover in a second position.

FIGS. 6 and 7 illustrates the terminal cover 90 and interlock element 92 in further detail. The terminal cover 90 in this embodiment is separately fabricated from the interlock element 92 such that the terminal cover 90 is slidably movable relative to the interlock element 92. Specifically, the interlock element 92 is formed with a channel or bore 100 that receives a bias element 102 such as a compression spring and a shank 104 formed with the interlock cover 90. As such, the terminal cover 90 may be moved relative to the interlock element 92 in the direction of arrow E, with the shank 104 thereby compressing the bias element 102 as shown in FIG. 7.

Thus, for example, when a fuse terminal blade 58 is received in the line side fuse clip 62 as described above, as the interlock element 92 and terminal cover 90 are moved toward the fuse clip 62 in the direction of arrow F and the leading edge of the terminal cover 90 eventually contacts the line side terminal blade 58 of the fuse module 54, but with the bias element 102 being partly compressed. Meanwhile, an interlock shaft 106 provided with the interlock element 92 is extended through an opening 108 in the terminal blade 58 as shown in FIG. 7. The extension of the shaft 106 through the terminal blade 58 couples the shaft 106 to the terminal blade 58 such that the terminal blade 58 cannot be disengaged from the line side fuse clip 60 by pulling of the fuse module in the direction of arrow G when the switch actuator 68 is closed and the device 50 is "on." As such, the terminal blade 58 cannot be disengaged from the line side terminal 60 when the device is "on" as shown in FIG. 7 (also shown in FIGS. 1 and 5). Also, in this state, the bias element 102 biases the terminal cover 90 in the direction of arrow F against the side of the terminal blade 58.

When the switch actuator 68 is moved to its "off" position (FIGS. 4 and 8), the interlock element 92 and the shaft 106 are moved in the direction of arrow E away from the line side fuse clip 60 and the terminal blade 58 such that the shaft 106 is withdrawn from the terminal blade opening 108 as seen in FIG. 6 and allowing the terminal blade 58 to be withdrawn from the fuse clip 60 in the direction of arrow G. Because of the shaft 106 in the interlock element 92, the terminal blade 58 can only be removed when the device 50 is "off." When the device 50 is "on" the terminal blade 58 is locked in place and cannot be withdrawn from the fuse clip 60.

Figure 2:
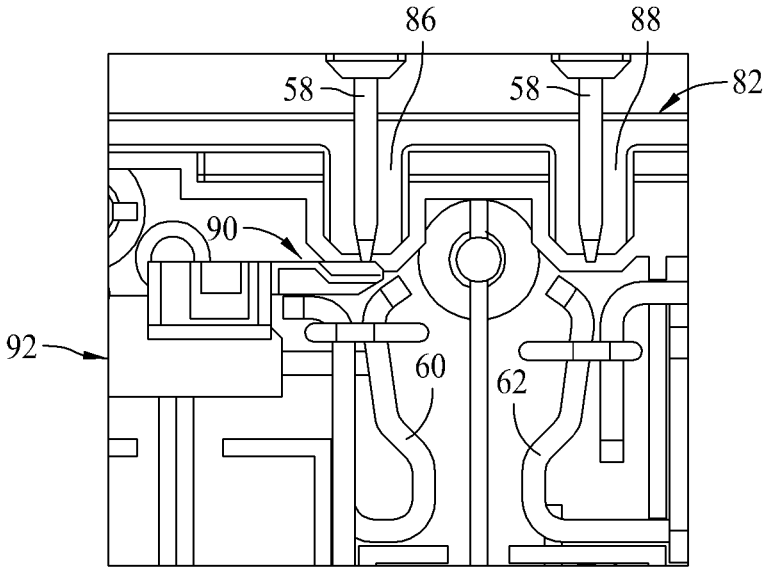
FIG. 2 is a magnified view of a portion of FIG. 1 illustrating a terminal cover in a closed position prohibiting access to a fuse terminal of the switch housing module while the switch contacts in the switch housing module are closed.
Figure 3:
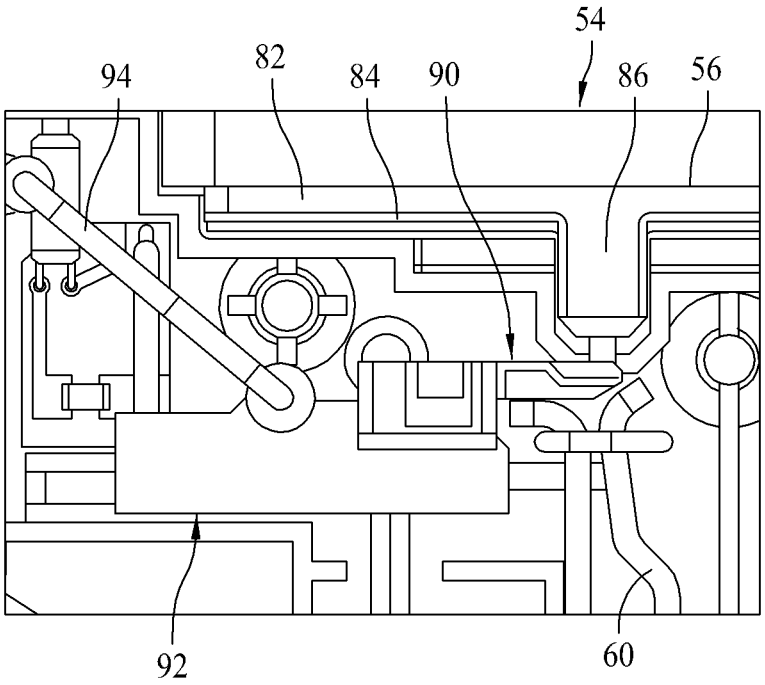
FIG. 3 is a view similar to FIG. 2 with the fuse module removed and the terminal cover in the closed position.

When the terminal blade 58 is withdrawn and clears the leading edge of the terminal cover 90, the terminal cover 90 is moved by the bias element 102 in the direction of arrow F so as to block the line side opening 86 in the fuse receptacle 82 as shown in FIGS. 2 and 3. As such, the same or different fuse module 54 may not be reinserted until the switch actuator 68 is moved completely to the opened or "off" position wherein the leading edge of the terminal cover 90 once again clears the line side opening 86 as shown in FIG. 4 and a terminal blade 58 of a fuse module 54 may again be reinserted.

The terminal cover 90 and the interlock element 92 may be fabricated from known nonconductive materials such as plastic or other suitable materials into various shapes, including but not limited to those depicted in the drawings, to accomplish the functionality described. It is contemplated that a variety of bias elements known in the art may be utilized in lieu of a compression spring to accomplish the independent movement of the cover element 90 described. It is understood, however, that the cover element 90 need not necessarily be independently movable from the interlock element 92 in at least some alternative embodiments. For instance, the terminal cover 90 and the interlock element 92 could be integrally combined in a single piece if desired while still achieving some of the benefits of the invention as described.

Further, while the combined interlock element 92 and terminal cover 90 is believed to be advantageous for the reasons stated, it is contemplated that these could be separately actuated and the terminal cover 90 need not necessarily be carried on the interlock element as described. It is also contemplated that in some embodiments one or the other of the terminal cover 90 and the interlock element 92 could be provided, but not necessarily both while still obtaining some of the benefits described.

In still further adaptations, it is noted that the terminal cover 90 may be alternatively shaped and dimensioned to block both the line side and load side terminal openings 86 and 88 (FIG. 1) in the fuse receptacle 82 rather than only the line side opening 86 as described. Moreover, an interlock element could be provided to engage a load side fuse clip 62 in addition to or in lieu of the embodiments shown in the drawings wherein only the line side fuse clip 60 is affected by the interlock.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fused disconnect switch for use with a retractable fuse having a terminal blade and an opening extending through the terminal blade, the fused disconnect switch comprising:

a nonconductive switch housing defining an exterior fuse receptacle and a first terminal blade opening formed through the nonconductive switch housing, the terminal blade opening configured to accept the terminal blade of the retractable fuse;

a line side terminal for establishing electrical connection with line side circuitry;

a line side fuse terminal proximate the first terminal blade opening and configured to establish an electrical connection with the terminal blade of the retractable fuse;

a switch actuator selectively positionable between a closed position completing an electrical path from the line side terminal to the line side fuse terminal and an open position disconnecting the electrical path from the line side terminal to the line side fuse terminal;

a nonconductive terminal cover operatively coupled to the switch actuator, the nonconductive terminal cover movable by the switch actuator between a first position and a second position, the nonconductive terminal cover in the first position blocking the first terminal blade opening and preventing access to the line side fuse terminal through the first terminal blade opening when the switch actuator is in the closed position, the nonconductive terminal cover in the second position permitting access to the line side fuse terminal through the first terminal blade opening; and a switch interlock shaft coupled to the switch actuator, wherein a portion of the switch interlock shaft is passed through the opening of the terminal blade and prevents removal of the terminal blade of the retractable fuse when the switch actuator is in the closed position.

2. The fused disconnect of claim 1, wherein the nonconductive terminal cover is slidably movable between the first position and the second position.

3. The fused disconnect switch of claim 1, wherein the nonconductive terminal cover is configured to be biased against the terminal blade of the retractable fuse when the switch actuator is in the closed position and when the terminal blade is accepted through the terminal blade opening.

4. The fused disconnect switch of claim 1, wherein the retractable fuse has a housing and portion of the housing projects from the exterior fuse receptacle when the terminal blade is accepted through the first terminal blade opening.

5. The fused disconnect switch of claim 1, wherein the exterior fuse receptacle further comprises a second terminal blade opening, and wherein the fused disconnect switch further includes a load side fuse terminal proximate the second terminal blade opening.

6. The fused disconnect switch of claim 5, wherein the nonconductive terminal cover does not block access to the second terminal blade opening when in the first position.

7. The fused disconnect switch of claim 6, the retractable fuse having a first terminal blade and a second terminal blade, and wherein an electrical connection is established through the retractable fuse between the line side fuse terminal and the load side fuse terminal when the first terminal blade and the second terminal blade are received in the respective first terminal blade opening and the second terminal blade opening.

8. The fused disconnect switch of claim 7, wherein the retractable fuse includes a rectangular housing and wherein the exterior fuse receptacle is configured to receive a portion of the rectangular housing.

9. The fused disconnect switch of claim 5, wherein the exterior fuse receptacle includes an open end and a bottom wall, and the first and second terminal blade openings are formed in the bottom wall.

10. The fused disconnect switch of claim 1, wherein the line side fuse terminal comprises a fuse clip configured to engage the terminal blade of the retractable fuse.

11. The fused disconnect switch of claim 1, further comprising a bias element engaging a portion of the nonconductive terminal cover.

12. The fused disconnect switch of claim 11, wherein the bias element is a compression spring.

13. The fused disconnect switch of claim 1, wherein the switch actuator is a rotary actuator.

14. The fused disconnect switch of claim 13, further comprising a sliding bar carrying first and second switch contacts, the sliding bar movable along a first axis.

15. The fused disconnect switch of claim 14, wherein the nonconductive terminal cover is movable along a second axis, the second axis being substantially perpendicular to the first axis.

16. The fused disconnect switch of claim 1, wherein the nonconductive terminal cover extends between a distal end of the line side fuse terminal and the first terminal blade opening when the switch actuator is in the closed position and when the terminal blade of the retractable fuse is disengaged from the line side fuse terminal.

17. The fused disconnect switch of claim 16, wherein the exterior fuse receptacle comprises a bottom wall, the nonconductive terminal cover extending parallel to the bottom wall.

18. The fused disconnect switch of claim 1, wherein the terminal blade is insertable through the first fuse blade opening along an insertion axis, the nonconductive terminal cover movable along a second axis between the first and second positions, and the second axis being substantially perpendicular to the first axis.

19. The fused disconnect switch of claim 1, further comprising an interlock element coupled to the switch actuator, the interlock shaft coupled to the interlock element and movable therewith, and wherein the nonconductive terminal cover is movable relative to the interlock element.

20. The fused disconnect switch of claim 19 wherein the interlock element is movable along a first linear axis, and the nonconductive terminal cover is movable along a second linear axis parallel to the first linear axis.

21. The fused disconnect switch of claim 1, wherein the switch actuator is a rotary actuator, the fused disconnect switch further comprising an interlock element and a linkage that connects the rotary actuator to the interlock element.

22. The fused disconnect switch of claim 1, further comprising an interlock element, the switch interlock shaft provided on and carried by the interlock element.

23. The fused disconnect switch of claim 22, wherein the interlock element is linked to the switch actuator.

24. A fused disconnect switch for protecting an electrical circuit with at least one fuse having a terminal blade and an opening extending through the terminal blade, the fused disconnect switch, comprising:

a nonconductive switch housing defining an exterior fuse receptacle and first and second terminal blade openings formed through the nonconductive switch housing in the exterior fuse receptacle;

a line side terminal carrying a first stationary contact;

a line side fuse terminal proximate the first terminal blade opening and comprising a second stationary contact;

a load side fuse terminal proximate the second terminal blade opening;

a switch actuator selectively positionable between a closed position and an open position;

a sliding bar coupled to the switch actuator and carrying first and second movable switch contacts, the first and second movable switch contacts completing an electrical path from the line side terminal to the line side fuse terminal when the switch actuator is in the closed position and disconnecting the line side terminal from the line side fuse terminal when the switch actuator is in the opened position;

a nonconductive terminal cover operatively coupled to the switch actuator and responsive thereto, whereby the nonconductive terminal cover is movable between a first position and a second position when the switch actuator is moved between the open and closed positions, the nonconductive terminal cover in the first position blocking the first terminal blade opening and preventing access to the line side fuse terminal through the first terminal blade opening; and an interlock shaft coupled to the nonconductive terminal cover, the interlock shaft configured to pass through the opening of the terminal blade and retain the terminal blade of the at least one fuse in position relative to one of the line side terminal and the load side terminal when the switch actuator is in the closed position.

25. The fused disconnect switch of claim 24, wherein the nonconductive terminal cover in the second position permits access to the line side fuse terminal through the first terminal blade opening.

26. The fused disconnect switch of claim 24, wherein the nonconductive terminal cover does not block the second terminal blade opening when in the first position.

27. The fused disconnect switch of claim 24, further comprising the at least one fuse, wherein the at least one fuse is a retractable fuse, the retractable fuse comprising first and second terminal blades, the first and second terminal blades passable through the first and second terminal blade openings when the nonconductive terminal cover is in the second position.

28. The fused disconnect switch of claim 27, wherein the retractable fuse is insertable into the exterior fuse receptacle along an insertion axis, the nonconductive terminal cover movable along a second axis that is substantially perpendicular to the insertion axis.

29. The fused disconnect switch of claim 28 wherein the retractable fuse is a rectangular fuse module.

30. The fused disconnect switch of claim 24, wherein the nonconductive terminal cover is located internal to the nonconductive switch housing in each of the first and second positions.

31. The fused disconnect switch of claim 24, wherein the nonconductive terminal cover is slidably movable between the first and second positions.

32. The fused disconnect switch of claim 24, wherein the nonconductive terminal cover is carried with the interlock shaft but is movable relative to the interlock shaft.

33. The fused disconnect switch of claim 24, wherein the nonconductive terminal cover includes a bias element.

34. The fused disconnect switch of claim 24, further comprising an interlock element coupled to the switch actuator, and the interlock shaft coupled to the interlock element.

35. The fused disconnect switch of claim 34, wherein the interlock element is linked to the switch actuator.

36. A fused disconnect switch comprising:

a switch housing defining an exterior fuse receptacle, the exterior fuse receptacle including first and second terminal blade openings;

line and load side fuse terminals situated interior to the switch housing proximate the respective first and second terminal blade openings;

a retractable fuse comprising a rectangular fuse module having first and second terminal blades passable through the first and second terminal blade openings to engage the line side and load side fuse terminals, at least one of the first and second terminal blades including an opening extending therethrough;

an interlock shaft movable between a first position and a second position, wherein in the first position a portion of the interlock shaft is passed through the opening of the at least one terminal blade to lock the retractable fuse in place; and a terminal cover mounted internal to the switch housing and movable between first and second positions, wherein the terminal cover blocks at least one of the terminal blade openings and prevents a passage of at least one of the first and second terminal blades therethrough when the terminal cover is in the first position, and wherein the terminal cover provides access to each of the first and second terminal blade openings for passage of the respective first and second terminal blades when the terminal cover is in the second position.

37. The fused disconnect switch of claim 36, further comprising a switch actuator movable between on and off positions, the terminal cover coupled to the switch actuator and the switch actuator driving movement of the terminal cover.

38. The fused disconnect switch of claim 36, further comprising a rotary switch actuator movable between on and off positions and a linearly movable interlock element, the terminal cover being carried on the interlock element.

39. The fused disconnect switch of claim 36, wherein the terminal cover is biased toward the first position.

40. The fused disconnect switch of claim 36, wherein in the first position the terminal cover blocks only one of the first and second terminal blade openings.

41. The fused disconnect switch of claim 36, further comprising an interlock element, the interlock shaft coupled to the interlock element.

42. The fused disconnect switch of claim 41, wherein the interlock element is linked to the switch actuator.

43. A fused disconnect switch for protecting an electrical circuit with at least one fuse having at least one terminal blade and an opening extending through the terminal blade, the fused disconnect switch, comprising:

a nonconductive switch housing defining an exterior fuse receptacle and first and second terminal blade openings formed through the nonconductive switch housing in the exterior fuse receptacle;

a line side terminal carrying a first stationary contact;

a line side fuse terminal proximate the first terminal blade opening and comprising a second stationary contact;

a load side terminal proximate the second terminal blade opening;

a switch actuator selectively positionable between a closed position and an open position;

a sliding bar coupled to the switch actuator and carrying first and second movable switch contacts, the first and second movable switch contacts completing an electrical path from the line side terminal to the line side fuse terminal when the switch actuator is in the closed position and disconnecting the line side terminal from the line side fuse terminal when the switch actuator is in the opened position;

an interlock element linked to the switch actuator and driven to respective first and second positions when the switch actuator is moved between the opened and closed positions;

a terminal cover coupled to the interlock element and movable therewith, whereby the terminal cover is movable between a first position and a second position when the interlock element is moved between the first and second positions, the terminal cover in the first position blocking at least one of the first and second terminal blade openings and preventing access to at least one of the line side fuse terminal and the load side fuse terminal through the blocked opening; and an interlock shaft, a portion of the interlock shaft configured to pass through the opening of the at least one terminal blade and retain the at least one terminal blade of the fuse in position relative to one of the line side terminal and the load side terminal when the switch element is in the closed position.

44. The fused disconnect switch of claim 43, further comprising a bias element interfacing the terminal cover and the interlock element.

45. The fused disconnect switch of claim 43, wherein the interlock element is movable along a linear axis.

46. The fused disconnect switch of claim 45, wherein the switch actuator comprises a rotary actuator.

47. The fused disconnect switch of claim 46, wherein the linear axis of the sliding bar is substantially perpendicular to the linear axis of the interlock element.

48. The fused disconnect switch of claim 45 further comprising a sliding bar carrying at least one switchable contact, the sliding bar movable along a linear axis.

49. The fused disconnect switch of claim 45, wherein the terminal cover is movable relative to the interlock element.

50. The fused disconnect switch of claim 49, wherein the terminal cover is movable along a linear axis parallel to the linear axis of the interlock element.

51. The fused disconnect switch of claim 49, wherein the terminal cover is biased against the at least one terminal blade when the switch element is in the closed position and when the at least one terminal blade is engaged to one of the line side fuse terminal and the load side fuse terminal.

* * * * *